US007641306B2

(12) United States Patent
Ohkuma

(10) Patent No.: US 7,641,306 B2
(45) Date of Patent: Jan. 5, 2010

(54) WIPER BLADE MEMBER FOR INK JET RECORDING HEAD, INK JET RECORDING APPARATUS HAVING WIPER BLADE AND INK JET RECORDING METHOD

(75) Inventor: Norio Ohkuma, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 335 days.

(21) Appl. No.: 11/290,497

(22) Filed: Dec. 1, 2005

(65) Prior Publication Data

US 2006/0125875 A1 Jun. 15, 2006

(30) Foreign Application Priority Data

Dec. 9, 2004 (JP) ..... 2004-356305

(51) Int. Cl.
*B41J 2/165* (2006.01)

(52) U.S. Cl. ..... 347/33

(58) Field of Classification Search ..... 347/33, 347/45, 106, 107; 428/422; 430/7
See application file for complete search history.

(56) References Cited

U.S. PATENT DOCUMENTS

| | | | | |
|---|---|---|---|---|
| 4,368,476 | A * | 1/1983 | Uehara et al. | 347/45 |
| 4,643,948 | A * | 2/1987 | Diaz et al. | 428/422 |
| 6,176,565 | B1 * | 1/2001 | Yanai et al. | 347/33 |
| 6,341,842 | B1 * | 1/2002 | Beach et al. | 347/45 |
| 6,455,209 | B1 * | 9/2002 | Okaniwa et al. | 430/7 |
| 7,063,403 | B2 * | 6/2006 | Wouters | 347/33 |
| 7,141,305 | B2 * | 11/2006 | Nakagawa et al. | 428/447 |
| 2003/0206214 | A1 * | 11/2003 | Soga et al. | 347/45 |
| 2004/0227785 | A1 * | 11/2004 | Katsuta et al. | 347/33 |

FOREIGN PATENT DOCUMENTS

| | | |
|---|---|---|
| JP | 5-201014 | 8/1993 |
| JP | 9-076517 | 3/1997 |
| JP | 9-202650 | 8/1997 |
| JP | 10-502096 | 2/1998 |
| JP | 2001-152139 | 6/2001 |

* cited by examiner

*Primary Examiner*—Julian D Huffman
*Assistant Examiner*—Alexander C Witkowski
(74) *Attorney, Agent, or Firm*—Fitzpatrick, Cella, Harper & Scinto

(57) ABSTRACT

A wiper blade member can maintain a high water repellency even for a pigment ink. The wiper blade member, which can eliminate a deposit on an ink discharge face of an ink jet recording head, is made water repellent by a condensate of a fluorine-containing hydrolysable compound. The condensate increases a fluorine content significantly and shows a strong adhesion to a substrate (blade) by the presence of the hydrolysable group. The condensate strongly adheres to the substrate by a condensation reaction only by hydrolysis, but the adhesion can be further improved by photo- or thermo-curing. The curing reaction can be executed at a relatively low temperature, without causing damage to the blade constituting the substrate.

3 Claims, 3 Drawing Sheets

WIPER BLADE MEMBER FOR INK JET RECORDING HEAD, INK JET RECORDING APPARATUS HAVING WIPER BLADE AND INK JET RECORDING METHOD

BACKGROUND OF THE INVENTION

1. Field of the Invention

The present invention relates to a wiper blade member for an ink discharge face of an ink jet recording head, an ink jet recording apparatus equipped with such wiper blade member, and an ink jet recording method.

2. Related Background Art

In an ink jet recording head, it is required to always clean an ink discharge face, thereby maintaining a stable discharge state. For such cleaning, various proposals have been made.

Regarding a wiper blade member, Japanese Patent Application Laid-open No. H09-076517 proposes to select a rubber hardness of a wiper blade within an optimum range, thereby achieving an improvement in the cleaning performance.

Also Japanese Patent Application Laid-open No. H05-201014 discloses an ether type polyurethane rubber as an optimum material for the wiper blade. It also discloses providing the ether type polyurethane rubber with a water repellent property to suppress an ink extraction from an ink discharge port, thereby improving the wiping performance.

In the recent ink jet recording, pigments are increasingly employed as a colorant of an ink, particularly a black ink, to be used. Such use of pigment is to achieve a high color development density and to improve a water resistance of a print.

In case of employing a pigment-based ink, a prior wiper blade may induce a deterioration in the print quality in a long-term use.

The wiper blade disclosed in Japanese Patent Application Laid-open No. H05-201014 has an excellent performance, but a further improvement is desirable for the use of a pigment-based ink. Japanese Patent Application Laid-open No. H05-201014 deals with an abrasion resistance of the wiper blade and a water repellency to the ink. The water repellency of the wiper blade to the ink is improved by adding a water repellent material to a polyurethane prepolymer constituting the wiper blade.

However, such method may be difficult, in case of employing a pigment-based ink as a recording ink, to maintain a high water repellency. In general, a pigment-based ink employed in ink jet recording utilizes a dispersion with a central particle size of about 50-150 nm, but such ink also contains a large number of particles of a size of about 20 nm or less, and such small particles are estimated to stick to the wiper blade surface, thereby inducing a deterioration in the water repellency. Causes of such phenomenon are estimated as follows.

In the aforementioned wiper blade, an addition amount of the water repellent material is limited, and the polyurethane and the water repellent material are present in mixed manner on the wiper blade surface. As the urethane compound contains a basically hydrophilic urethane bond, the pigment particles of above-mentioned small size stick to such hydrophilic portion.

Also at the formation of the wiper blade, surface irregularities of an order of nanometers are formed and the pigment particles of small size stick to such surface irregularities. In an example of Japanese Patent Application Laid-open No. H05-201014, a surface of a formed wiper blade showing presence of a water repellent material, in an observation under a microscope, is defined as "particles" while a surface not showing such particles is defined as "mutually dissolved", but the irregularities in the nanometer order are assumed to be present even in those described as "mutually dissolved".

SUMMARY OF THE INVENTION

The present invention has been made in consideration of the aforementioned situation. A wiper blade member of the present invention, for eliminating a deposit sticking to an ink discharge face of the ink jet recording head, is characterized in being subjected to a water repellent treatment with a condensate of a fluorine-containing hydrolysable compound.

The present invention also provides an ink jet recording apparatus equipped with such wiper blade member.

Further, the present invention provides an ink jet recording method in which a water repellent treatment on a nozzle face (ink discharge face) and that on a wiper blade member are both executed with a fluorine-containing hydrolysable compound.

DETAILED DESCRIPTION OF THE PREFERRED EMBODIMENTS

Figure 1A:
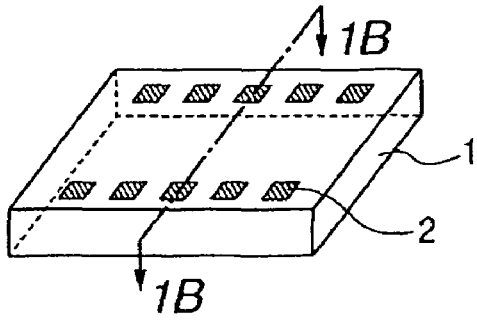
FIGS. 1A, 1B, 1C, 1D, 1E, 1F and 1G are schematic views showing a producing process for an ink jet recording head in which the present invention is applicable.

In the following, the present invention will be clarified in detail.

In a water repellent treatment of a wiper blade, it is difficult to completely eliminate hydrophilic portions on the wiper blade surface by a method of internally adding a water repellent material to a blade material as described above, and also difficult to reduce the irregularities on the blade surface. It is therefore preferable to form a water repellent layer by a surface coating after a blade is prepared. However, following points have to be considered in case of forming a water repellent layer on a surface coating after the blade preparation:

- a sufficient adhesion is attained between the wiper blade and the water repellent layer;
- the water repellent layer can be formed flat by absorbing irregularities on the wiper blade surface; and
- wiper blade characteristics (rubber elasticity) should not be sacrificed in the course of forming the water repellent layer.

As a result of studies undertaken by the present inventor for meeting these requirements, a water repellent compound described in Japanese Unexamined Patent Publication No. 10-502096 has been found useful, and the present invention has thus been made. The above-mentioned water repellent compound is based on a condensate of a hydrolysable silicon compound having a fluorine-containing group and a silicon compound having a non-hydrolysable group, and is provided with a photo- or thermo-setting property by introducing, if necessary, a photo- or thermo-curable functional group in a part of the non-hydrolysable group.

Such condensate is capable of significantly increasing a fluorine content, and shows an excellent adhesion to a substrate (blade) by the presence of the hydrolysable group. Also it is strongly adhered to the substrate (blade) by a condensation reaction only by a hydrolysis, but the adhesion can be further improved by a photo- or thermocuring. In such case, the curing reaction can be executed at a relatively low temperature, without causing a damage to the blade constituting the substrate.

Japanese Patent Application Laid-open Nos. H9-202650 and 2001-152139 employ a fluorinated silane coupling agent singly as a water repellent material and disclose its usefulness. However, these references state that a high-temperature process of 600-700° C. is necessary for obtaining a sufficient adhesion between the fluorinated silane coupling agent and the substrate. The blade material requiring a rubber elasticity is naturally unable to withstand such high temperature treatment. On the other hand, the water repellent compound described in Japanese Unexamined Patent Publication No. 10-502096 necessitates presence of water in condensing the hydrolysable group, and is reacted in the presence of a water-soluble solvent or in the absence of solvent. Also a hydrolysis generally generates an alcohol-type compound as a reaction product. Thus, this water repellent compound is soluble in an alcohol solvent, and may be dip coated in forming the water repellent layer on the blade, without a detrimental effect thereto. In contrast, an ordinary fluorine- or silicon-based water repellent material is soluble in a polar solvent such as ketone, ester or ether, but is insoluble in an alcohol solvent. The water repellent material utilizing such polar solvent, when used in dip coating for forming a water repellent layer on the blade, may undesirably induce a dissolution or a significant swelling of the blade by the polar solvent. Also a dip coating employed for forming a water repellent layer on the blade can suppress surface irregularities on the surface of the water repellent layer. It is generally difficult to control the surface irregularities in a blade formed by heat molding, so that a water repellent layer of a high film forming property is preferably formed by a post treatment. According to the investigation of the present inventor, the blade requires a surface roughness Ra of 100 nm or less, preferably 50 nm or less. It is found that, with a surface roughness exceeding 100 nm, fine pigment particles intrude recessed portions of the irregularities, thereby deteriorating the water repellency of the blade surface. The surface roughness Ra means a height of a center line in a standard deviation of a distance from a bottom to a peak of the irregularities, and is a parameter measurable with an atomic force microscope (AFM).

In the following, an ink jet recording method of the present invention will be explained.

The water repellency of the wiper blade significantly influences the wiping performance as explained above, and it is also found, by the investigation of the present inventor, that equivalent water repellencies of the wiper blade and the nozzle face are important for the wiping performance. "Equivalent" mentioned above means that a difference in a receding contact angle of the nozzle face and the wiper blade surface is 20° or less in absolute value.

Figure 3:
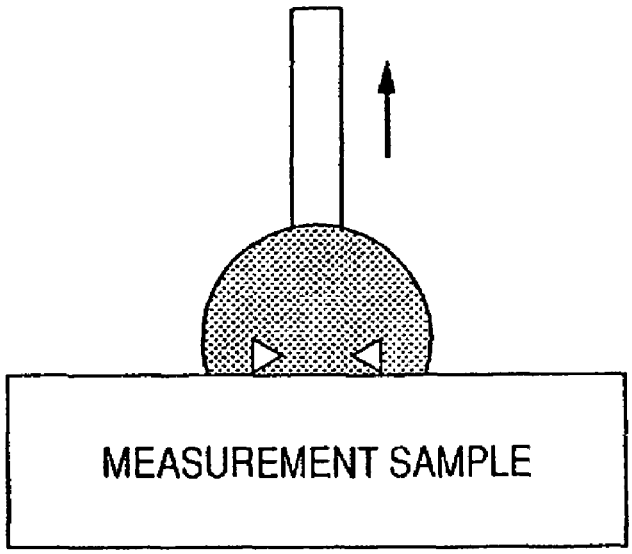
FIG. 3 is a schematic view showing a method of measuring a receding contact angle against ink.
Figure 4:
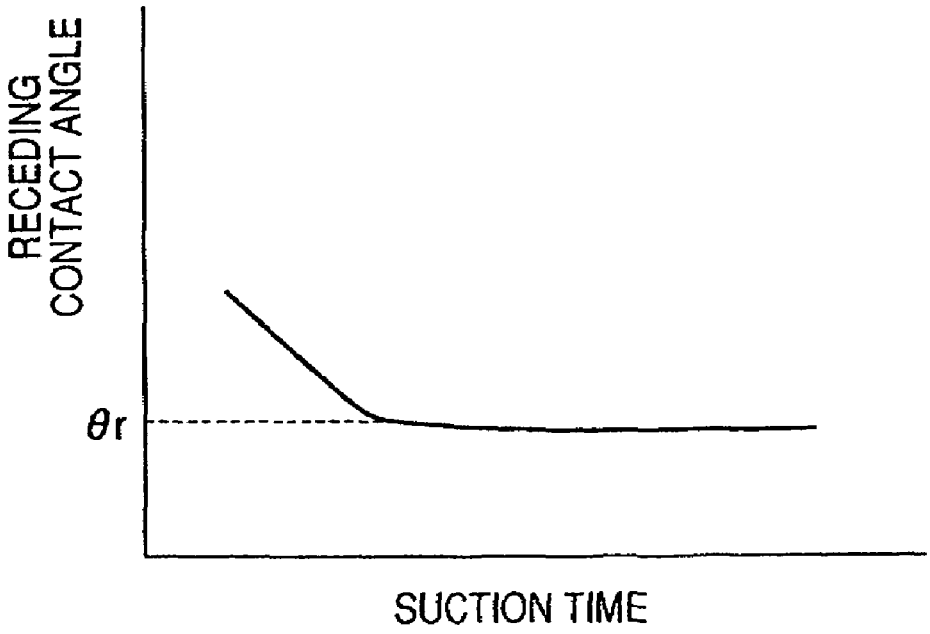
FIG. 4 is a schematic view for explaining a definition of a receding contact angle.

The receding contact angle is measured, as shown in FIG. 3, in a state where an ink droplet is formed from a syringe and is maintained in contact with a measured surface. The receding contact angle means an angle formed between the measured surface and the ink droplet when the ink droplet moves on the measured surface at a constant speed under a suction by the syringe. FIG. 4 shows a change in the angle formed between the measured surface and the ink droplet as a function of an ink suction time. A region with a constant angle corresponds to an ink droplet displacement at a constant speed on the measured surface, and such angle is taken as the receding contact angle. Thus the receding contact angle is a parameter indicating an ease of displacement of liquid after the measured surface is subjected to a contact history with the liquid to be measured, and, on an ink jet nozzle face, a parameter indicating an ease of ink wiping. A larger receding contact angle is considered to indicate a smaller work required for displacing the ink droplet.

According to the investigation of the present inventor, even with a high receding contact angle of the nozzle face against the ink, a low receding contact angle of the wiper blade against the ink may result in a situation where the wiping performance cannot be maintained over a long period. Such situation where the wiping performance cannot be maintained over a long period may also result when the receding contact angle is high on the wiper blade but low on the nozzle face. The cause of such phenomena is not yet clarified, but it is estimated that, when either of the nozzle face and the wiper blade surface is more wettable by the ink, an ink deposit is formed in a deviated state and repeated wiping operations in such deviated state generate a state facilitating the adsorption of the small pigment particles in the ink.

According to the investigation of the present inventor, a receding contact angle θr (nozzle face) of the nozzle face against the ink and a receding contact angle θr (wiper blade member) of the wiper blade member to the ink preferably have a difference within 20° in absolute value.

Also in the layers of the water repellent material on the nozzle face and on the wiper blade surface, it is difficult to completely maintain the water repellency (receding contact angle) over a prolonged period of use and a certain deterioration has to be anticipated. The deterioration of the water repellency is a property inherent to the water repellent material, and, by forming the nozzle face and the wiper blade surface with a same water repellent material, proceeds in a similar level on both surfaces. It is therefore possible to maintain the difference between receding contact angle θr (nozzle face) of the nozzle face against the ink and the receding contact angle θr (wiper blade member) of the wiper blade member against the ink within 20° in absolute value.

Thus, even in case of a certain deterioration in the water repellency, the deterioration proceeds similarly on the nozzle face and the wiper blade surface and the wiping performance is not deteriorated extremely.

The present invention has been explained by a case of employing a pigment-based ink for recording, but the present invention is naturally effective also in case of utilizing a dye-based ink for recording.

In the following, examples of the present invention will be explained.

(Preparation of Wiper Blade)

An isocyanate-containing polyurethane polymer, and, as curing agent, polyethylene glycol and 1,4-butanediol were mixed by agitation under heating, and the mixture was charged in a pre-heated centrifugal molder and cured under heating to obtain a sheet-shaped molded member (thickness: 1 mm) for wiper blade. The sheet-shaped molded member was punched to prepare a wiper blade 1.

Also a wiper blade 2 was prepared in a similar manner but adding, at the preparation, 3-(2-perfluorohexyl)ethoxy-1,2-dihydroxypropane as a water repellent material.

(Preparation of Water Repellent Material)

Methacryloxypropyl trimethoxysilane and methyl triethoxysilane were subjected to a hydrolysis-condensation in the presence of water, then perfluorooctyl triethoxysilane was added and a hydrolysis-condensation was conducted to obtain a base liquid. It was diluted with ethanol so as to obtain a concentration of non-volatile components of 10%, then added with a photopolymerization initiator (Irgacure 165, manufactured by Ciba-Geigy Ltd.) by 1.5% and was finally filtered with a filter of a pore size of 1.0 μm to obtain a regulated liquid.

(Formation of Water Repellent Layer on Wiper Blade)

The wiper blade 1 was subjected to a dip coating by immersing in the regulated liquid. The immersion was conducted for 2 minutes, and, after evaporation of the solvent of the regulated liquid, a UV irradiation in a UV curing oven, followed by a heating for 10 minutes at 90° C., was conducted to cure the water repellent layer, thereby obtaining a wiper blade 3. The water repellent layer was formed with a thickness of about 1 μm.

The wiper blades 1-3, thus prepared, were subjected to following measurements.

<Measurement of Receding Contact Angle>

A receding contact angle against the ink was measured as described before, with an automatic contact angle measuring instrument CA-W, manufactured by Kyowa Interface Science Co.

An ink employed for the measurement was a pigment-based black ink of a composition:

| | |
|---|---|
| carbon black dispersion | 30 parts |
| trimethylolpropane | 6 parts |
| diethylene glycol | 6 parts |
| isopropyl alcohol | 5 parts |
| surfactant | 0.2 parts |
| water | 52.8 parts. |

<Measurement of Surface Roughness Ra>

A surface roughness Ra was measured with a scanning probe microscope (AFM) JSPM-4210, manufactured by JEOL, in an AC mode.

Table 1 shows measured values on the wiper blades before and after the water repellent layer formation.

TABLE 1

| | receding contact angle against ink (°) | surface roughness Ra (nm) | rubber hardness (JISA) |
|---|---|---|---|
| wiper blade 1 | 40 | 120 | 69 |
| wiper blade 2 | 63 | 104 | 70 |
| wiper blade 3 | 72 | 15 | 70 |

Table 1 indicates that the wiper blade 3 with the formed water repellent layer shows, in comparison with the wiper blade 1 without the water repellent layer and the wiper blade 2 incorporating the water repellent material, not only an improvement in the receding contact angle against water but also a significant improvement in the surface roughness. Also the rubber hardness is not lost by the formation of the water repellent layer.

(Preparation of Ink Jet Nozzle)

Figure 1B:
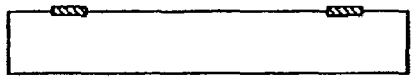

Now reference is made to FIGS. 1A, 1B, 1C, 1D, 1E, 1F and 1G for explaining a nozzle forming process for an ink jet recording head to which the present invention is applicable. FIG. 1A shows a state where an electrothermal transducing element 2 is provided on a substrate 1 (electrode, etc., being not shown). FIG. 1B is a cross-sectional view along a line 1B-1B in FIG. 1A.

Figure 1C:
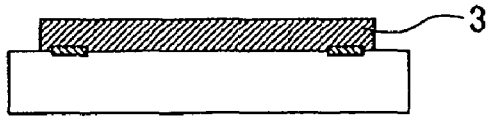
Figure 1D:
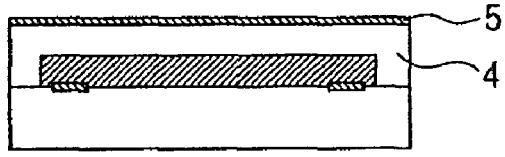
Figure 1E:
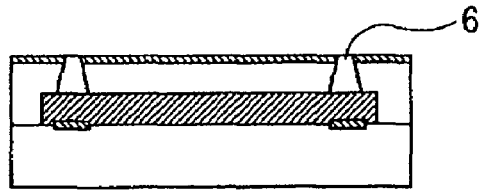
Figure 1F:
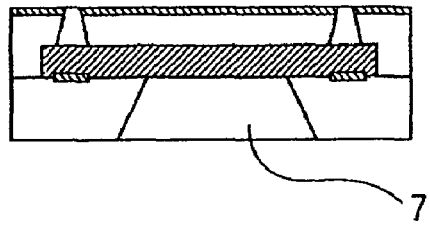
Figure 1G:
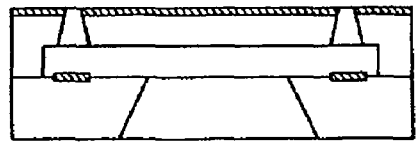

At first, on the substrate 1, an ink flow path pattern 3 is formed by a positive photoresist (FIG. 1C). Then, on the ink flow path pattern, there are provided a nozzle material 4 constituted of a negative photoresist, and a water repellent material 5 constituted of a negative photoresist containing fluorine and siloxane molecules (FIG. 1D), and an ink discharge port 6 is formed by a photolithographic process (FIG. 1E). Then, after the nozzle face is suitably protected, an anisotropic etching on silicon is executed from the rear surface of the substrate 1 to form an ink supply aperture 7 (FIG. 1F). Then the ink flow path pattern is dissolved out (eluted) to complete an ink jet nozzle (FIG. 1G). Finally, electric parts and an ink supply member are mounted to complete an ink jet recording head.

EXAMPLE 1

Figure 2:
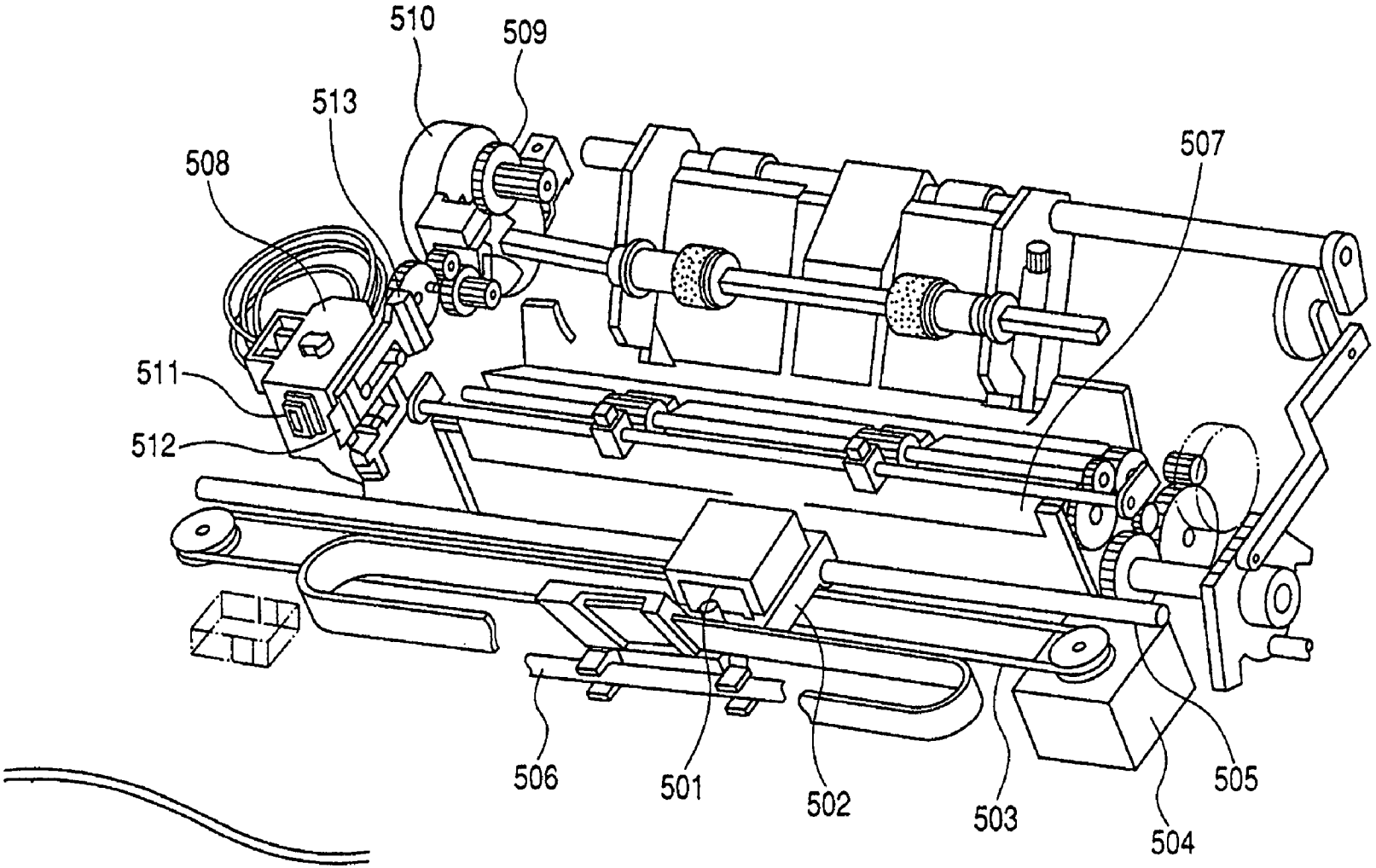
FIG. 2 is an external perspective view of a wiper blade of the present invention and an ink jet recording apparatus equipped with such wiper blade.

Now, an ink jet recording apparatus utilized for the aforementioned evaluations will be briefly explained. FIG. 2 is an external perspective view of an ink jet recording apparatus in which the blade of the present invention is mounted.

In FIG. 2, an ink jet head cartridge (IJC) 501 is provided with a group of nozzles, for ink discharge onto a recording surface of a recording sheet supplied to a platen 507. A carriage (HC) 502 for supporting the IJC 501 is connected to a part of a driving belt 504 for transmitting a driving power of a driving motor 503, and is rendered slidably movable along two parallel guide shafts 505, 506, thereby enabling a reciprocating motion of the ink jet head over an entire width of the recording sheet.

A head recovery apparatus 508 is provided at an end of the moving path of the IJC 501, for example in a position opposed to a home position thereof. The head recovery apparatus 508 is operated by a driving power of a motor 510 through a driving mechanism 509, thereby executing a capping of the IJC 501. In association with the capping of the IJC 501 by a cap portion 511 of the head recovery apparatus 508, there is executed an ink suction by suitable suction means provided in the head recovery apparatus 508 or a pressurized ink supply by suitable pressurizing means provided in an ink supply path to the IJC 501, thereby forcedly discharging the ink from the discharge ports and thus executing a discharge recovery process such as elimination of a viscosified ink in the nozzles. Also at the end of a recording operation, the recording is protected by such capping.

A wiper blade 512 bearing a water repellent layer of the present invention is provided on a lateral face of the head recovery apparatus 508. The blade 512 is supported by a cantilever structure by a blade support member 513, and is operated, like the head recovery apparatus 508, by the motor 510 and the transmission mechanism 509, thereby being enabled to engage with a discharge face of the IJC 501. Thus the blade 512 is made to protrude into a moving path of the IJC 501 at a suitable timing within a recording operation of the IJC 501 or after a discharge recovery process by the head recovery apparatus 508, and wipes off a dewing, a wet liquid or dusts on the discharge face of the IJC 501 in the movement thereof.

At first, the ink jet nozzle face prior to use was subjected to a measurement of the contact angle against the aforementioned pigment-based ink. Then the apparatus shown in FIG. 2 was used to execute a sequence of executing 100 ink discharges to the cap and then executing a single wiping (cleaning), by 10,000 cycles, 50,000 cycles and 100,000 cycles. The contact angle of the ink jet nozzle face against the pigment-based ink was measured at each stage. The wiper blade had a free length of 4 mm and a penetration amount of 1.5 mm to the head surface.

Results are shown in Table 2.

TABLE 2

| | receding contact angle of nozzle face | | | |
|---|---|---|---|---|
| | initial | after 10,000 cycles | after 50,000 cycles | after 100,000 cycles |
| wiper blade 1 | 71 | 52 | 40 | 35 |
| wiper blade 2 | 71 | 60 | 45 | 39 |
| wiper blade 3 | 71 | 69 | 61 | 55 |

As will be apparent from Table 2, the wiper blade 3 of the present invention is significantly different in the deterioration of the receding contact angle on the nozzle face in the wiping test.

Then an evaluation on an actual image was conducted in the same manner as explained above. A predetermined pattern was printed after every 20,000 wiping operations, and the operation was continued to 100,000 wiping operations. Obtained results are shown in Table 3.

TABLE 3

| | initial | after 20,000 cycles | after 40,000 cycles | after 60,000 cycles | after 80,000 cycles | after 100,000 cycles |
|---|---|---|---|---|---|---|
| wiper blade 1 | ◎ | ○ | Δ | Δ | X | X |
| wiper blade 2 | ◎ | ○ | ○ | Δ | Δ | X |
| wiper blade 3 | ◎ | ◎ | ◎ | ○ | ○ | Δ |

Table 3 clearly indicates the usefulness of the wiper blade 3 of the present invention.

EXAMPLE 2

Then an ink jet nozzle was prepared by employing, as the water repellent material layer 5 in the preparation of the ink jet nozzle described in the foregoing example, a material employed in the water repellent layer of the wiper blade. The nozzle face had a contact angle of 72° against the black pigment ink. Then an image evaluation in the wiping test was conducted in the same manner as in Example 1, utilizing the wiper blade 3. Results are shown in Table 4.

TABLE 4

| | initial | after 20,000 cycles | after 40,000 cycles | after 60,000 cycles | after 80,000 cycles | after 100,000 cycles |
|---|---|---|---|---|---|---|
| wiper blade 3 | ◎ | ◎ | ◎ | ◎ | ○ | ○ |

As shown in Table 4, a further enhanced effect could be obtained by forming the nozzle face and the water repellent layer of the wiper blade with a same water repellent material.

A composition constituting the wiper blade generally contains a residue of a reaction initiator added in the synthesis of a base polymer, a by-product in such synthesis, a low-molecular component of the base polymer, and a vulcanizing agent, a softening agent, a plasticizer, etc., added at the formation of the rubber member. Therefore, such components may be exposed or percolated to the blade surface in a prolonged use and may deteriorate the performance of the blade.

However, the wiper blade of the present invention also has an effect that the water repellent layer provided on the surface suppresses the exudation of such low-molecular components from the rubber layer. It therefore shows a better durability as a wiper member to be employed in the ink jet recording apparatus.

This application claims priority from Japanese Patent Application No. 2004-356305 filed on Dec. 9, 2004, which is hereby incorporated by reference herein.

What is claimed is:

1. An ink jet recording apparatus comprising:

an ink jet recording head including an ink discharge face for discharging an ink; and a wiper blade for eliminating a deposit on the ink discharge face of the ink jet recording head, wherein the wiper blade and the ink discharge face are coated with a water repellent layer made from a condensate of the same fluorine-containing hydrolysable silane compound.

2. An ink jet recording apparatus comprising:

an ink jet recording head including a nozzle face for discharging an ink; and a wiper blade for eliminating a deposit on the nozzle face of the ink jet recording head, wherein the wiper blade and the nozzle face are coated with a water repellent layer made from a condensate of a fluorine-containing hydrolysable silane compound, and wherein a receding contact angle Θr (nozzle face) of the nozzle face to the ink and a receding contact angle Θr (wiper blade) of the wiper blade to the ink satisfy a relation:

$$|\Theta r\ (\text{nozzle face}) - \Theta r\ (\text{wiper blade})| \leqq 20°.$$

3. An ink jet recording apparatus according to claim 1, wherein the condensate of the fluorine-containing hydrolysable silane compound is made from methacryloxypropyl trimethoxysilane methyltriethoxysilane and perfluorooctyl triethoxysilane.

* * * * *